US006092923A

United States Patent [19]

Perrot

[11] Patent Number: 6,092,923

[45] Date of Patent: Jul. 25, 2000

[54] TIMEPIECE INCLUDING FIXATION DEVICE FOR AN ELEMENT ADDED TO A FRAME

[75] Inventor: Friedrich Perrot, Lengnau, Switzerland

[73] Assignee: Eta SA Fabriques d'Ebauches, Grenchen, Switzerland

[21] Appl. No.: 08/345,813

[22] Filed: Nov. 22, 1994

[30] Foreign Application Priority Data

Nov. 23, 1993 [CH] Switzerland ..... 3485/93

[51] Int. Cl.[7] ..... G04B 37/00

[52] U.S. Cl. ..... 368/309; 368/88; 368/236; 368/300; 368/314

[58] Field of Search ..... 368/10, 300–310

[56] References Cited

U.S. PATENT DOCUMENTS

| | | | |
|---|---|---|---|
| 476,748 | 7/1892 | Ketchem . | |
| 5,430,694 | 7/1995 | Perrot | 368/88 |

FOREIGN PATENT DOCUMENTS

| | | |
|---|---|---|
| 637801 | 8/1983 | Switzerland . |
| 646570 | 12/1984 | Switzerland . |
| 646555 | 11/1950 | United Kingdom . |
| 2100891 | 1/1983 | United Kingdom . |
| 2257461 | 1/1993 | United Kingdom . |

*Primary Examiner*—Bernard Roskoski
*Attorney, Agent, or Firm*—Sughrue, Mion, Zinn, Macpeak & Seas, PLLC

[57] ABSTRACT

The invention relates to a timepiece having a body or frame upon which an added element may be held, in a detachable manner. The invention also relates to a method of assembling this element on said body or frame.

This timepiece is characterized in that the fixation means of the element added to the body or frame are formed by at least one rotating bolt (10) which is anchored permanently in the material itself of the body or frame (2) and is axially immobilized by said material.

10 Claims, 4 Drawing Sheets

TIMEPIECE INCLUDING FIXATION DEVICE FOR AN ELEMENT ADDED TO A FRAME

BACKGROUND OF THE INVENTION

The present invention concerns a timepiece including a frame upon which is held, in a detachable manner, and with the aid of a particular fixation device, an added element.

Further, this invention concerns a method of assembling such an element on a frame of the type mentioned above.

More particularly, the invention concerns a timepiece and an assembling method, in which the frame is formed of a synthetic material, said added element being made of any material, for example a metal material.

It is also to be noted that in a particular application, the added element may advantageously be formed by a protective plate applied against the frame, and added to the latter in order to protect certain of the fragile components of said timepiece.

In conventional timepieces, such protection plates are held in a detachable manner by screws whose thread is inserted into the synthetic material forming the frame.

This arrangement has numerous disadvantages which detract from the quality and durability of the timepiece.

Further, when the added piece is dismantled and reassembled on the frame, this arrangement can lead to damage of the components by the fixation device.

In timepieces whose frame is formed of a synthetic material, such as for example plastic, the assembly, dismantling and reassembling operations of the added elements, such as protection plates of the type mentioned above, lead to the progressive tearing of the threads formed in the synthetic material. Thus, the number of dismantling/reassembling operations of the plate on the frame must be relatively limited.

Further, given that it is very difficult to measure the tightening forces which are applied when the screw is manually put back in place in the hole which has been tapped by the screw itself in the frame (self-tapping screw), it may happen that this force is markedly greater than the shearing resistance of the threads and, at the time of the first reassembling, this excessive force may ruin the threads and render inoperative the gripping action of the screw against the plate.

It is also to be noted that, during these operations, screws which are very small may be lost by the operator.

Further, as numerous components are arranged in a very compact manner in the timepiece and as certain of them, such as for example the coil, are not necessarily covered by the protective plate, the operator's tool which is level with the plate, may slip when the screw or screws are being put into place and harm, for example, the wires of the coil causing serious damage to the coil.

It is thus clear that this type of fixation is not satisfactory for the detachable assembly of an added element on a frame of a timepiece forming, in particular, a plate made of a synthetic material.

Further, it has been proposed that fixing members functioning with a click mechanism be provided directly on the added element. However, in view of the size of the components concerned, these members present real manufacturing difficulties and their operation is uncertain, because of the low margins required for the operation of this type of device and the difficulties in ensuring such low margins in the manufacturing of frames in synthetic material.

SUMMARY OF THE INVENTION

Thus a purpose of the present invention is to address the above-mentioned disadvantages by providing a timepiece, in which the above-mentioned added element is held on the frame by detachable fixation means capable of sustaining a plurality of dismantling and reassembling operations while preserving their reliability, and whose installation on the frame, as well as subsequent dismantling and reassembling operations, do not risk harming the fragile components of the timepiece.

The invention thus concerns a timepiece of the type including a body or frame on which is held, in a detachable manner, an added element, such as, for example, a protective plate, this element being held on the body or frame by fixation means attached to the body or frame able to rotate whilst remaining at a constant height in relation to the body or frame to enable said added element to be unlocked and released, this invention being characterised in that the fixation means are comprised of at least one bolt which is permanently anchored in the material itself of the body or frame, and is axially immobilised in relation to the latter.

This invention also concerns a method of assembling an added element on the body or frame of a timepiece, characterised in that it consists of:

arranging an initial hole in said body or frame, providing at least one fixing bolt intended to hold in place an element added to the body or frame, this bolt having at least one shoulder and at least one locking wing, and introducing said bolt into the initial hole of the body or frame while distorting the material forming the body or frame in order to lead it to cover said shoulder, so as to hold said bolt in place by means of the material itself of the body or frame, the bolt in this position being suited to holding said added element.

Other characteristics and advantages of the present invention will become clear upon reading the following detailed description of two embodiments of the invention, in the light of the attached drawings, given here solely by way of example.

DETAILED DESCRIPTION OF THE INVENTION

Figure 1:
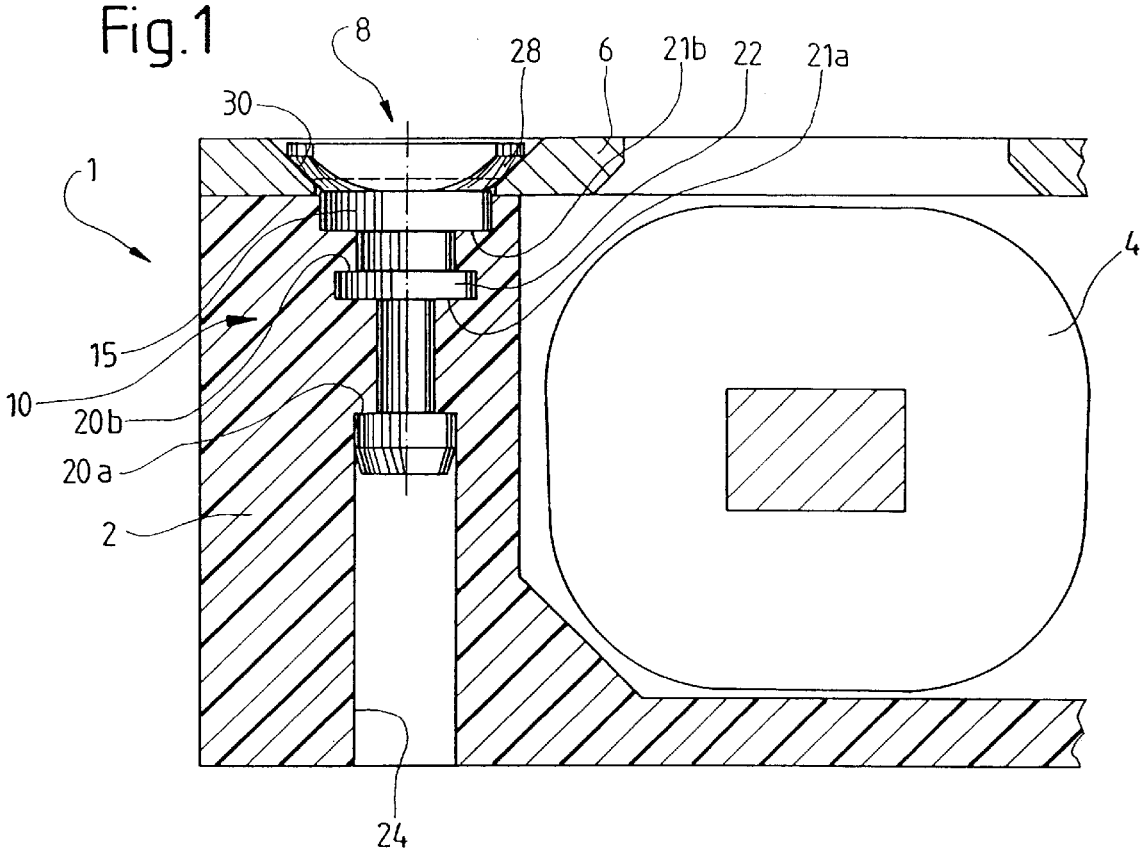
FIG. 1 is a cross-sectional view along the line I—I of FIG. 2, representing a timepiece shown here partially, this timepiece being provided with fixation means, according to a first embodiment of the invention, which are shown in the position in which they lock an added element onto a frame of said timepiece.

Referring henceforward to FIG. 1, a description will be given below of a timepiece according to the invention identified by the general reference 1.

Timepiece 1 comprises a body 2 forming for example a frame, formed of a synthetic material, notably a plastic material, such as polysulphide phenylene (PPS) or in a non-limitative manner, of another synthetic material.

On body or frame 2 which, in the application shown, forms a plate, an excitation coil 4 is mounted, shown here in a very schematical view.

Further, on the same frame 2, an added element 6 is assembled in a detachable way, forming here by way of example, a plate called a protective plate, intended either to protect certain of the components (not shown) of timepiece 1, or to provide this timepiece with a distinctive appearance.

It can be seen that in this example of an embodiment, protective plate 6 does not entirely cover coil 4 due to the external diameter of this coil, which must be as large as possible, for reasons of the energy provided, whilst the thickness of the movement must be as small as possible.

Timepiece 1 according to the invention also comprises fixation means 8 which are attached to frame 2 and which hold added element 6 firmly in place, but in a detachable manner.

In an advantageous manner, fixation means 8 are formed of one or more bolts 10 (only one being shown here) which are permanently anchored in the material itself of body or frame 2, and are axially immobilised, in relation to said body or frame, by said material, these bolts being capable of rotating in the body or frame.

Figure 7:
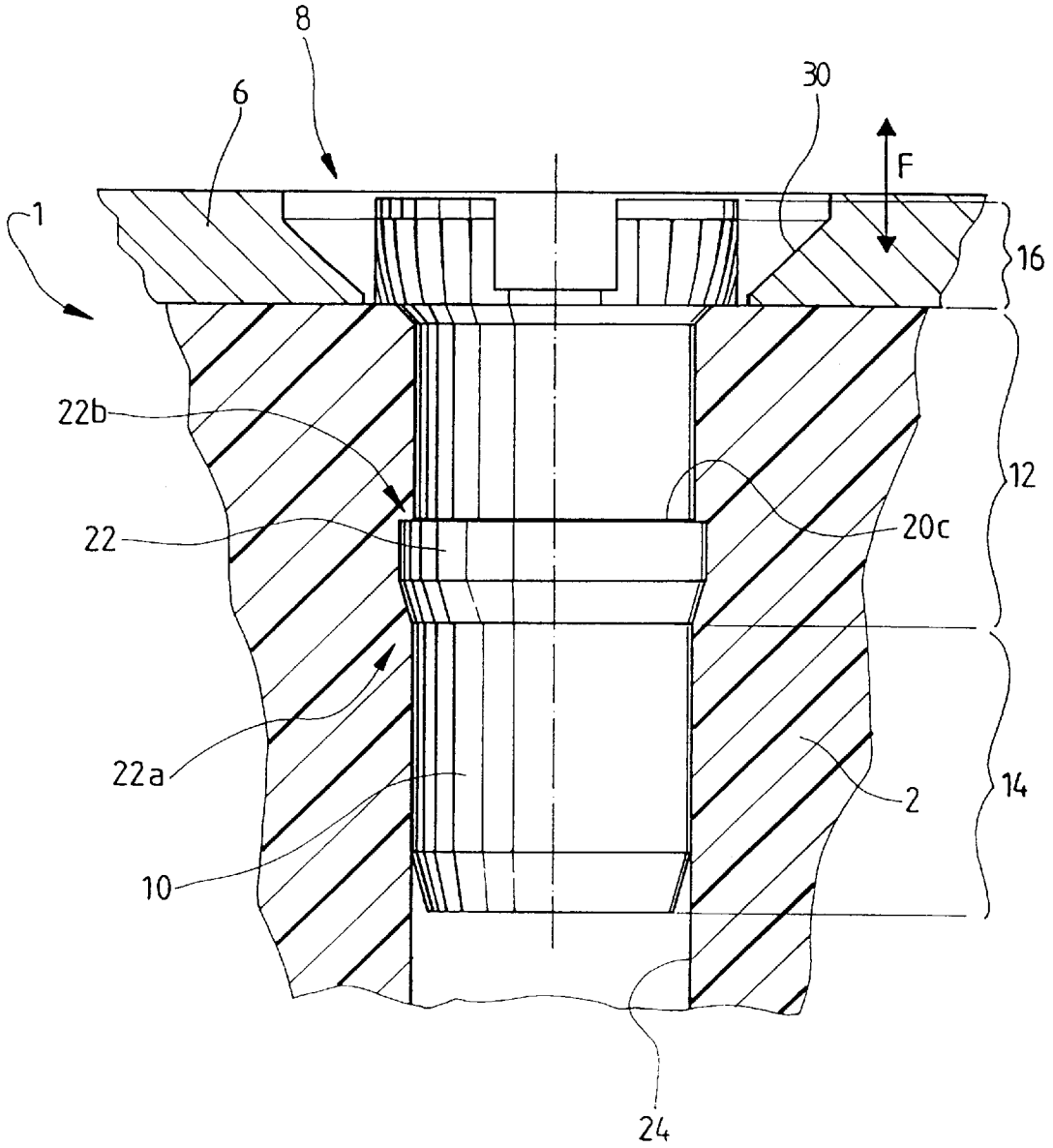
FIG. 7 is a similar view to FIG. 3, but showing the invention according to a third embodiment.

As will be understood below, rotating bolt or bolts 10 may be rotated in frame 2 while remaining at a constant height in relation to the latter. It will also be understood, as seen in FIGS. 3 and 7, that this angular movement of the bolt enables added element 6 to be unlocked and released in relation to frame 2 (according to arrow F).

Figure 3:
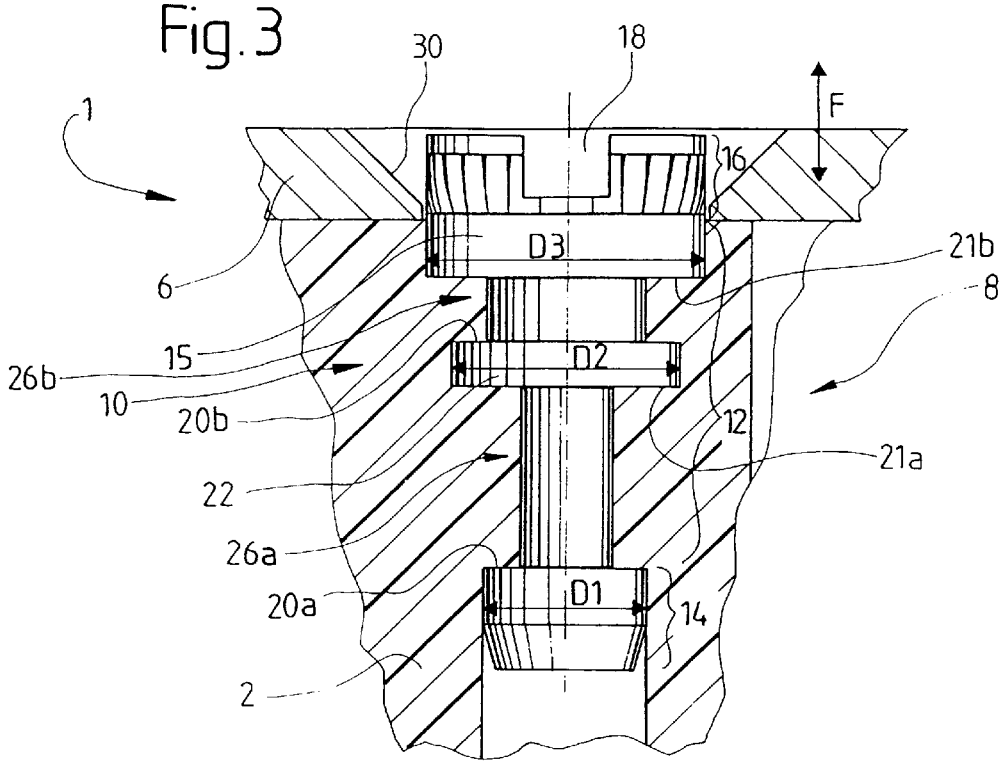
FIG. 3 is a cross-sectional view along line III—III of FIG. 4, and showing the fixation means of FIG. 1, but in the position in which the added element is released.

As is seen more clearly in FIG. 3, each bolt 10 comprises a body 12 which is provided, at a first end, with a foot 14 and at a second end, opposite to the first, with a head 16.

Head 16 comprises a straight slot 18 which enables bolt 10 to be rotationally activated by a tool, not shown, for example a screwdriver.

Body 12 of bolt 10 comprises, at the end opposite to foot 14, a cylindrical base 15 which is arranged below head 16 and which is partially embedded into frame 2.

Each bolt 10 thus has the form of an essentially cylindrical metallic element, in a generally elongated shape.

Body 12 of bolt 10 is provided with one or more holding shoulders 20*a,* 20*b* which extend transversely in relation to body 12, and which are held axially (FIGS. 1, 3 and 5) by one or more distorted regions of the material forming frame 2, when bolt 10 is in place in the latter. As is seen in FIGS. 1, 3 and 5, the material of body or frame 2 covers the shoulder or shoulders 20*a,* 20*b;* the body of bolt 10 being embedded as an insert into this material. Further, in the two embodiments of FIGS. 1 to 5, body 12 of each bolt 10 includes along its length at least one flange 22 which is anchored fixedly, that is to say permanently, in the material forming frame 2, this flange thus participating in the holding of bolt 10 in the frame.

In fact in these two embodiments bolt 10 is provided with two holding shoulders 20*a,* 20*b;* the first shoulder 20*a* being arranged on foot 14 and in particular on its side oriented towards head 16, said foot 14 also being chamfered at its free end to enable bolt 10 to be introduced into the material of the frame, and in particular into an initial hole 24 (FIG. 1) arranged in the latter. The second holding shoulder 20*b* is arranged on flange 22, also on the side of head 16.

As is seen in FIG. 7, flange 22 of the third embodiment is chamfered on a first side 22*a,* oriented towards foot 14, while it has a flat transverse shoulder referenced 20*c* on its second side 22*b* which is opposite to the first 22*a* and which is oriented towards head 16. This arrangement enables bolt 10 to be inserted into frame 2 by deformation at room temperature.

It is to be noted here that, in the embodiments which have just been described, it is preferable that each flange 22 is of a circular shape and extends continuously around body 12 of bolt 10. In an alternative embodiment not shown, this flange 22 may be formed by one or more angular segments partially covering body 12.

As is seen in FIGS. 1, 3, 5 and 7, flange 22 is arranged on body 12 of bolt 10, at a distance in relation to foot 14.

In the embodiments shown, this flange 22 is arranged approximately in the middle of body 12, namely in a median area of the latter.

It will be noted (FIG. 3) that base 15 has an external diameter D3 which is greater than that, referenced D2, of flange 22; this same diameter D2 of flange 22 being greater than the external diameter D1 of foot 14.

Thus bolt 10 has a staggered profile, the external line of this bolt varying progressively from foot 14 to head 16.

As will be understood below, the arrangement of holding shoulders 20*a,* 20*b* improves the tearing resistance characteristics of bolt 10 when it is firmly anchored into the material itself of frame 2, which has been deformed, in these embodiments, by heat and by flow at the time when the bolt is installed.

It will also be noted that bolt 10 comprises, in the embodiments of FIGS. 1 to 5, two other shoulders 21*a,* 21*b* arranged respectively below flange 22 and below base 15. These shoulders are oriented towards foot 14, and they ensure the upsetting of the synthetic material of the frame, under the force of introducing the bolt into the latter.

In the first embodiment, and as is seen in FIG. 3, shoulders 20*a* and 21*a* are formed by the two faces of a radial groove 26*a* formed in the body of said bolt, between foot 14 and flange 22. Bolt 10 also comprises a second radial groove 26*b,* arranged between flange 22 and base 15 and forming shoulders 20*b* and 21*b*.

It will thus be noted that the geometry of bolt 10 which has just been described, must be such that the material which has been deformed by flow by shoulders 21*a,* 21*b* has sufficient space to come to lodge itself into grooves 26*a* and 26*b* and to fill them. Thus grooves or recesses 26*a* and 26*b* must define at least a volume equal to that of the material upset by shoulders 21*a* and 21*b*.

As is seen in FIGS. 1 to 5, head 16 of bolt 10 has radial wings 28, here four in number, which are able to be moved in an angular direction by a corresponding action of the tool, not shown, in slot 18. These wings 28 are formed to cover, in a position called the locking position, one or more supporting areas 30, notably in a partially truncated form or in the form of a cylindrical recess (not shown), arranged directly on added element 6 in order to ensure that the latter is held on frame 2.

Although the four wings 28 are shown here on head 16, it is to be noted that the latter may have another structure with one or a different number of wings 28.

Figure 2:
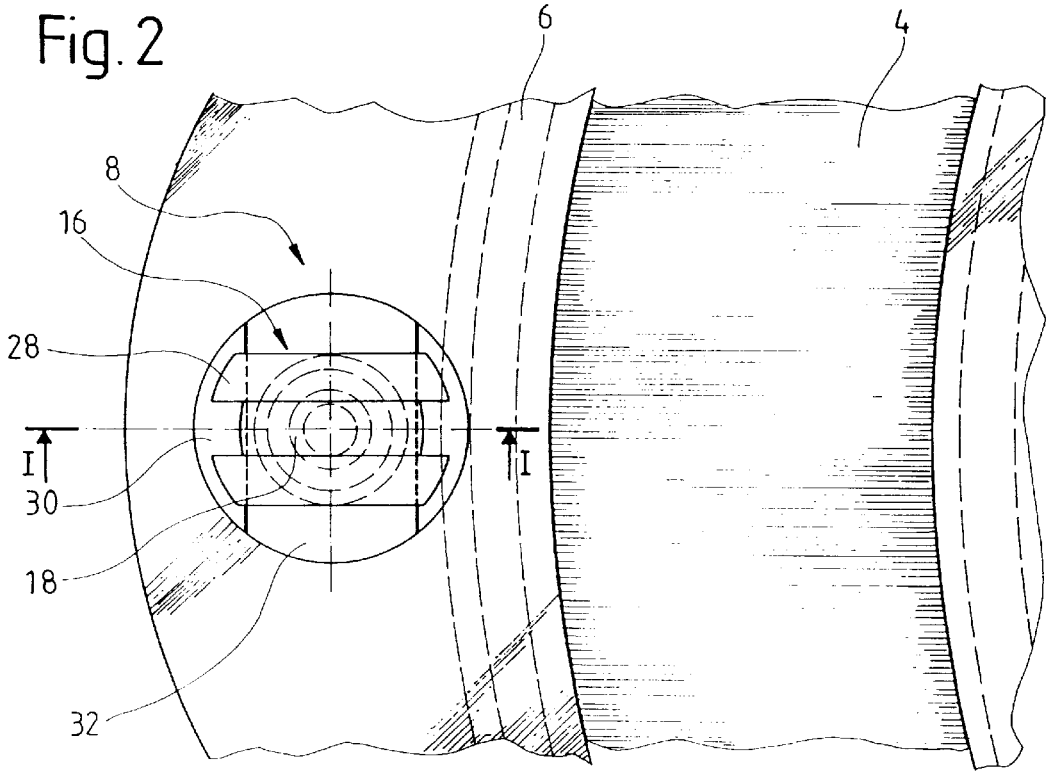
FIG. 2 is a top view of FIG. 1, partially showing the added element assembled on said frame.
Figure 4:
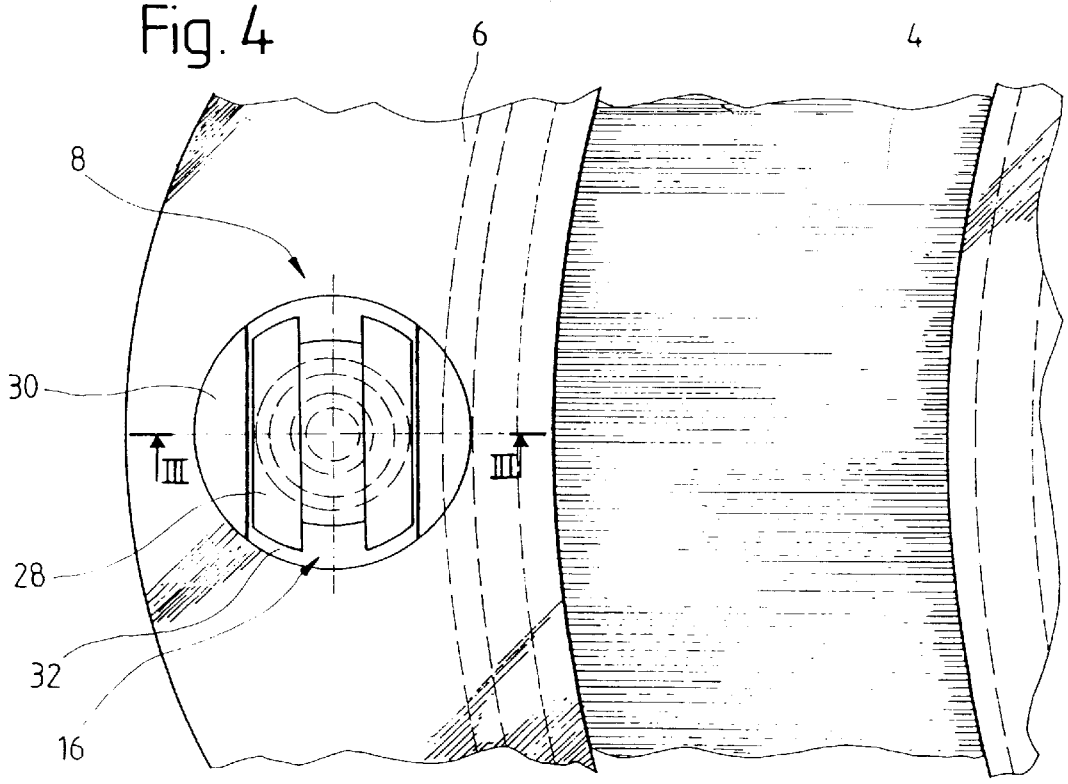
FIG. 4 is a top view of FIG. 3.
Figure 5:
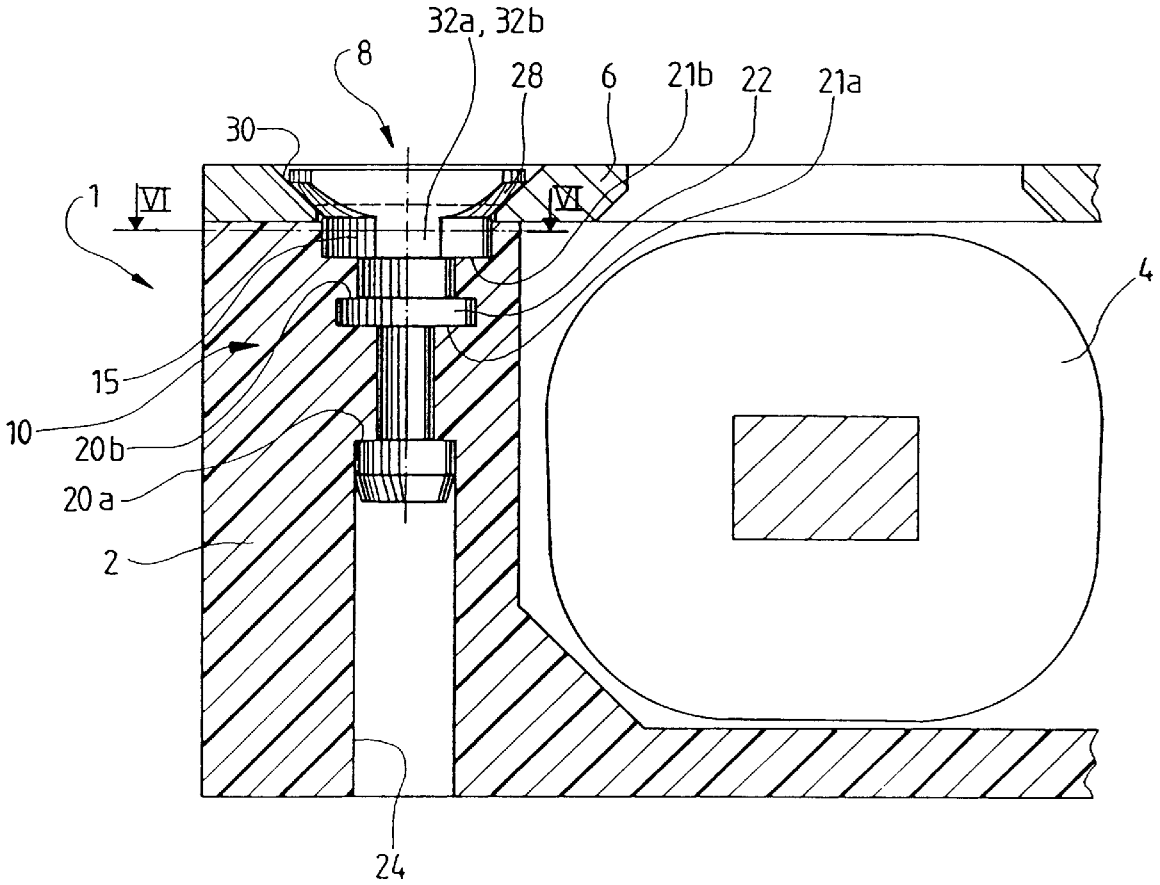
FIG. 5 is a similar view to FIG. 1, but showing a second embodiment of the invention.

As is seen in FIGS. 2 to 4, each supporting area 30 is arranged by the deformation of a rim, not referenced, of an access orifice 32 formed in added element 6. This deformation may be achieved by deformation of the material at room temperature, for example by stamping.

Figure 6:
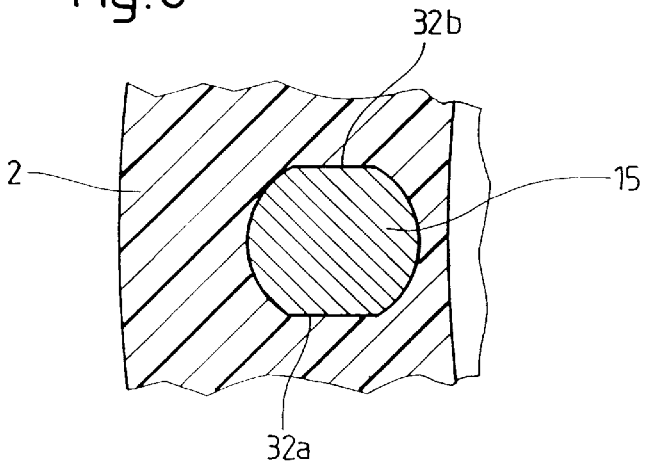
FIG. 6 is a partial cross-sectional view along the line VI—VI of FIG. 5.

Referring to FIGS. 5 and 6, it can be seen that according to another embodiment bolt 10 comprises lateral flat parts 32*a,* 32*b* arranged on either side of base 15 and extending in a longitudinal direction in relation to body 12. These flat parts 32*a,* 32*b* (two in this example) form (FIG. 6), when the bolt is installed, corresponding flat shapes in the material of frame 2. These flat parts ensure that bolt 10 is held in its angular locking position, and when the latter is rotated by a tool, they form means of increasing the rotational torque in the material. These flat parts are formed by machining to one particular dimension the straight lateral flanks of head 16 and slot 18, by one and the same operation, with the aid of a cutter train. Although two flat parts have been shown here, it is clear that in an alternative not shown, a single one may be provided on bolt 10.

As has been specified above, the invention also concerns a method of assembling added element 6 on frame 2. In this method, one or more initial holes 24 are first arranged in frame 2, then added element 6 is provided, arranged with one or more access orifices 32.

After added element 6 has been installed on frame 2, one or more fixation bolts 10 are provided, such as that which has just been described.

Then, each bolt 10 is introduced, oriented preferably towards its locking position (FIGS. 1, 2, 5 and 6) into an initial hole 24 arranged in frame 2, via access orifice 32 of added element 6, at the same time deforming the material forming frame 2, by the action of upsetting shoulders 21*a,* 21*b* to lead this upset material to cover shoulder or shoulders 20*a,* 20*b*. This introduction of bolt or bolts 10 into the material of frame 2 is pursued until locking wing or wings 28 of each bolt 10 come into contact with supporting areas 30 to rest on added element 6.

It is to be noted here that in the embodiments of FIGS. 1 to 6, the material of frame 2 is deformed by heating the material, the heat being provided by the bolt itself, during its installation.

This heating of the material is caused for example by applying high frequency vibrations to bolt 10 as it is pushed into its initial hole 24. These frequencies are preferably selected in the ultrasonic range.

In the embodiment of FIG. 7, bolt 10 is installed by deformation at room temperature of the material of frame 2.

It is thus clear that each bolt 10 is preferably installed in timepiece in an angular position so that wings 28 cover supporting area 30. In other words, bolt or bolts 10 are installed on the timepiece in their angular locking position to come to abut upon added element 6 and also to define their appropriate operating height in relation to this element.

Thus, at the time when it is installed, each bolt 10 automatically arranges, in the course of its own introduction, straight recesses or grooves in the material forming frame 2. These recesses or grooves, not referenced, ensure the axial holding in place of bolt 10 but enable its rotation to unlock wings 28 of supporting areas 30 and to enable the release of protective plate 6 when wings 28 in their turned position (FIGS. 3 and 4) coincide with the recess formed by orifice 32.

Head 16 of bolt 10 remains at a constant height, whether this bolt is in its locking position or unlocking position. Thus, when the end of a tool, not shown, such as a screwdriver, is introduced into slot 18 of head 16 which remains embedded in added plate 6, this tool end is held laterally by the rim of access orifice 32 of added plate 6, and cannot slip and possible harm one of the constituents of timepiece 1, notably the coil in the present case.

Further, as the rotation of bolt 10 does not involve, during dismantling and reassembling operations, any axial movement of the bolt, there is no risk of tearing the synthetic material of the frame, which improves the life span of this arrangement. Further, when these operations are carried out, the pushing of the screwdriver towards the frame does not involve any axial movement of the bolts downwards, the latter being stabilised towards the bottom by upsetting shoulders 21*a,* 21*b*.

As bolts 10 are firmly fixed, that is to say permanently, in frame 2, there is nor risk of losing them when dismantling/reassembling operations are carried out.

Finally, said bolts 10 enable this arrangement to be used in frames with walls of small thickness.

What is claimed is:

1. A timepiece comprising:

a frame;

a fixation means attached to the frame; and an added element held on the frame in a detachable manner by the fixation means;

said fixation means being able to rotate while remaining at a constant height in relation to the frame to enable said added element to be unlocked and released;

said fixation means having at least one bolt anchored in the material of the frame and axially immobilized in relation to the frame.

2. A timepiece according to claim 1, wherein the bolt comprises a body provided with at least one shoulder which is held axially by a deformed part of the material forming said frame.

3. A timepiece according to claim 2, wherein the body of the bolt comprises along its length at least one flange which comprises said shoulder and which is permanently anchored in the material forming said frame, this flange improving the holding of the bolt in the frame.

4. A timepiece according to claim 3, wherein said flange is chamfered on a first side oriented towards a foot of said bolt while it has a straight shoulder on a second side, opposite to the first one.

5. A timepiece according to claim 3, wherein said flange is arranged at a distance in relation to a foot of said bolt.

6. A timepiece according to claim 5, wherein said flange has an external diameter greater than that of the foot.

7. A timepiece according to claim 2, wherein said shoulder is formed by a face of a radial groove arranged in the body of the bolt.

8. A timepiece according to claim 1, wherein said bolt has a head with at least one wing able to be moved in an angular direction and formed to cover in a position called the locking position, a supporting area arranged on the added element in order to ensure its holding on the frame.

9. A timepiece according to claim 8, wherein said supporting area is arranged by the distortion of a rim of an access orifice formed in the added element.

10. A timepiece according to claim 1, wherein the bolt comprises at least one lateral flat part extending in a longitudinal direction in relation to the latter and comprising in the material of the frame a corresponding flat shape to increase the rotational torque of the bolt in said frame.

* * * * *